United States Patent [19]

Tamai

[11] Patent Number: 4,671,687

[45] Date of Patent: Jun. 9, 1987

[54] ERASER OF CHARACTERS ETC.

[76] Inventor: Shigeru Tamai, 6-11-1-510, Toneyama, Toyonaka-shi, Osaka-fu, Japan

[21] Appl. No.: 759,208

[22] Filed: Jul. 26, 1985

[30] Foreign Application Priority Data

Jul. 31, 1984 [JP] Japan ..... 59-162071

[51] Int. Cl.[4] ..... B41J 29/28; B41J 31/09

[52] U.S. Cl. ..... 400/695; 400/700; 400/696

[58] Field of Search ..... 400/695, 696, 697, 697.1, 400/700; 156/DIG. 1, DIG. 6, DIG. 24, DIG. 33, DIG. 42, DIG. 48

[56] References Cited

U.S. PATENT DOCUMENTS

| | | | |
|---|---|---|---|
| Re. 31,726 | 11/1984 | Sato | 156/DIG. 33 X |
| 1,222,592 | 4/1917 | Baldwin | 400/696 X |
| 2,238,518 | 4/1941 | Dieck | 400/234 |
| 2,400,435 | 5/1946 | Nelson et al. | 156/DIG. 48 X |
| 2,568,904 | 9/1951 | Weber et al. | 156/DIG. 42 X |
| 3,339,797 | 9/1967 | Knutson | 156/DIG. 48 X |
| 3,889,310 | 6/1975 | Barouh et al. | 400/696 X |
| 4,274,906 | 6/1981 | Clar | 156/DIG. 42 X |
| 4,525,237 | 6/1985 | Clar | 156/DIG. 48 X |

FOREIGN PATENT DOCUMENTS

| | | | |
|---|---|---|---|
| 0672063 | 7/1979 | U.S.S.R. | 400/696 |

*Primary Examiner*—Edgar S. Burr
*Assistant Examiner*—Joseph McCarthy
*Attorney, Agent, or Firm*—Armstrong, Nikaido, Marmelstein & Kubovcik

[57] ABSTRACT

An eraser of the present invention comprises a magazine having set therein a carriage means for mounting a freely turning first reel loaded with an erasing ink transfer tape and a second reel for winding up the used erasing ink transfer tape and a head for bending or curving the erasing ink transfer tape before it is wound up by the second reel wherein at least the bent or curved portion of the tape is projecting with respect to the magazine. The known defects of the conventional erasing ink, such as requiring a relatively long waiting time before rewriting, difficulty of rewriting due to brush unevenness and inconvenience caused by drying and solidifying of erasing ink as well as the fatal defect of the conventional eraser of transfer type that it is usable only for typewriter, is eliminated with present invention. The invention provides a handy eraser that is quite easy to use.

4 Claims, 6 Drawing Figures

ERASER OF CHARACTERS ETC.

BACKGROUND OF THE INVENTION

1. Field of the Invention

The present invention relates to an eraser for erasing hand-written, type-written, copied or block copied characters, symbols etc. and in particular to an eraser which applies an erasing ink in place.

2. Description of the Prior Art

Hitherto, as representative of such eraser for characters, symbols etc. has been known a method of applying with a brush a quick-drying erasing ink prepared by dispersing a pigment of high hiding power in a medium or dissolving the same in a solvent. It, however, has a number of defects that, among others, it takes a relatively long time before the ink, if quick drying, should dry out to enable rewriting on the eraser film, that the eraser film is subject to unlevelness due to brushing unevenness, this, too, interfering with rewriting, that the erasing ink tends to dry out in the periphery of the container's mouth to interfere with proper use of the erasing ink, that the erasing ink tends to dry if the container is not capped tightly, that there is a risk of the erasing ink being spilt to stain clothing etc., that the erasing ink can not be kept prolongedly and that erasing is infeasible with characters etc. written by a certain kind of marking ink.

Hitherto, there has been also known a type of erasing ink transfer tape in which an erasing ink layer is formed on a base film over a layer of releasing agent and an adhesive is coated to form the outermost layer. Although this is free of the drawbacks mentioned above, it is problematic about the following points. That is, this is designed to set on a typewriter a first reel loaded with the erasing ink transfer tape together with a second reel for winding the unwound and used portion of such tape and do erasing by typing again the character etc. this time over the erasing ink transfer film so as to have the erasing ink transferred onto the character etc., hence this type of erasing film transfer tape is applicable only to typewriter and lacks the general-purpose feature of the erasing ink.

SUMMARY OF THE INVENTION

The present invention relates to an erasing ink transfer tape which is applied to erasing characters etc. by transfer of an erasing ink under preservation of the general-purpose feature of a conventional erasing ink.

Further objects and advantages of the present invention will be apparent to those skilled in the art from the following detailed description of the invention.

DETAILED DESCRIPTION OF THE INVENTION

Figure 1:
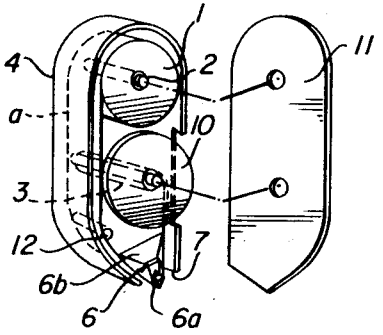
FIG. 1 is a perspective view taken of an embodiment of the present invention with the lid open.

An eraser for accomplishment of the present invention comprises a magazine, in which a first reel loaded with an erasing ink transfer tape and a second reel for winding up the used tape are properly arranged, and a head which causes the erasing ink transfer tape unwound from the first reel to be bent or curved before it is wound up on the second reel and the aforesaid point of bending or curving is projected with respect to the magazine.

In the present specification the "erasing ink transfer film" is, as described in the appended claim, composed of a base film, an erasing ink layer formed on one side thereof over a layer of releasing agent and a superposing layer of adhesive, and the "second reel loaded with erasing ink transfer tape" is meant a reel having such tape coiled thereon with the adhesive layer out.

Described below is a preferred embodiment of the present invention under reference to the accompanying drawings.

In the figures reference numeral 1 designates a first reel loaded with an erasing ink transfer tape (a), 2 is a means on which the first reel 1 is rotatably mounted and 3 is a second reel for winding up the erasing ink film unwound from the first reel 1, and as reel 1 can be used a bush coiled with the erasing ink transfer tape (a), as the means 2 can be used a spindle and as the second reel 3 can be used another bush mounted on a positively driven spindle.

An example of erasing ink transfer tape (a) comprises a plastic base film (generally in thickness of approximately 25–38$\mu$) which is coated on one side with a release layer such as of vinyl chloride copolymer, low molecular polyethylene or silicone, a white ink layer theron and further a superposing layer of adhesive (pressure sensitive adhesive) such as polyurethane.

Figure 2:
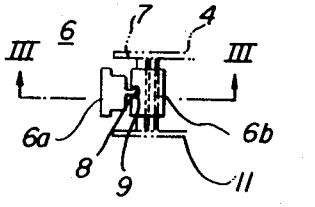
FIG. 2 is a plan view of the head of the same embodiment.
Figure 3:
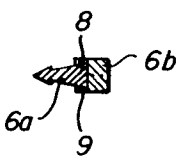
FIG. 3 is a sectional view taken along the line III—III of the FIG. 3.

The aforesaid carriage means 2 is fixedly set in the magazine 4 of a handy size which can be picked up with fingers or held with a single hand, and the second (wind-up) reel is also fixedly set in the magazine. Reference numeral 6 designate a head for causing the erasing ink transfer tape (a) to bend or curve outside before it is wound up by the second reel 3. The tip 6*a* of the head 6 is somewhat projected beyond the window 7 of the magazine, the greater part of the head 6 being fixed inside the magazine 4. The head 6 can be substantially triangle in side view, and preferably the tip portion 6*a* of the head 6 which comes into contact with the tape is formed separate from the body portion 6*b* of the head so that the tip portion 6*a* can swing in the left-right direction (up-down in FIG. 2) with respect to the body portion 6*b* of the head. The swinging structure is composed of a shaft portion 8 formed on the base side of the tip portion 6*a* of the head and a mating shaft groove 9 formed in the front end face of the head body portion 6*b*, the former being fitted in the latter in a freely turning manner.

Reference numeral 10 designates a dial fixedly attached to one end of the second (wind-up) reel 3, and by turning it with fingers or the like, the second reel 3 can be turned. Reference numeral 11 designates a freely removable cover of the magazine 4 and 12 a guide pin for the tape (a).

With the eraser of the present invention whose composition has been described above, characters, symbols or the like can be erased in the following way.

First the cover 11 of the magazine 4 is opened, the first reel 1 is then mounted on the spindle provided as carriage means 2, the erasing ink transfer tape (a) is pulled out and its tip is led over the head 6 and fixed to the second or wind-up reel 3. In this state the unwound tape (a) is bent or curved in the form defined by the side view of the aforesaid tip portion 6*a*, and the bent or curved portion is projected out of the window 7 of the magazine 4. Then the cover 11 is closed with respect to the magazine 4. Now the magazine 4 is ready for use with the first reel 1 loaded with the erasing ink transfer tape (a) set in place.

The magazine 4 with the tape (a) thus set is held with fingers or a hand, and the bent or curved portion of the tape (a) is pressed against the character or symbol to be erased and, when the magazine 4 is now moved toward the left side of the head 6, the erasing ink in the bent or curved portion of the tape (a) is transferred to erase the same, and at the same time the tape (a) is unwound of the first reel 1. The used portion of the tape (a) is wound up by turning the second reel 3 lest it should slack.

In the illustrated embodiment the tip portion 6*a* of the head 6 is shiftable transversally with respect to the tape (a) so that, even if the magazine 4 should move slightly sideways, the tip portion 6*a* automatically compensates so that the tape (a) in that portion is properly adjusted for the erasing ink to be transferred in place without fail. The compensating angle of the tip portion 6*a* of the head may usually be 15° or so each to the left and right.

In the above described is a preferred embodiment of the present invention but, needless to say, the invention is not to be limited thereby, but various modifications are possible without deviation from the spirit of the present invention.

Figure 4:
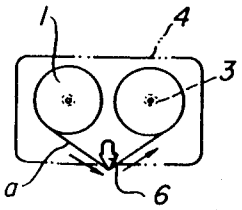
FIGS. 4 and 5 are front views showing variations of arrangement of the reels and the head.
Figure 5:
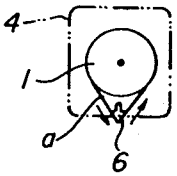
Figure 6:
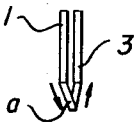
FIG. 6 is a side view of FIG. 5.

For instance, the reels 1 and 3 and the head 6 may be arranged sideways as shown in FIG. 4 or as well be arranged overlappingly as shown in FIGS. 5 and 6. Further, it is a preferable embodiment that the second reel 3 is driven mechanically by a spring of such a spring force that when slackiness should result in the downstream region (on the second reel side) of the head 6, the second reel 3 is thus turned automatically, and if not, it would not turn due to the pulling-out resistance of the tape (a). When the second reel 3 is loaded by a spring for mechanical winding up, it may alternately be so designed with an ordinary spring with an escape mechanism different in strength from the above-mentioned spring, such ordinary spring allowing retraction of the head 6 with respect to the magazine 4 but having a spring urge to push forward the head. So, another alternative is that when the head 6 is pressed against the character or the like on paper to be erased, the retraction of the head with regard to the magazine 4 automatically releases the escape mechanism and, when the head 6 is lifted off the paper, the escape mechanism becomes effective again. According to the present invention, the first reel loaded with the erasing ink transfer tape is mounted on the carriage means of the above-mentioned magazine, the erasing ink transfer tape is unwound from the first reel to have its tip fixed to the second reel over the head. Then, with the reel loaded with the erasing ink transfer reel thus set in the magazine, the magazine is held with fingers or by hand and, with the bent or curved portion of the erasing ink transfer tape pressed against the paper with the character etc. to be erased on, the magazine is to be moved in the desired direction, which should agree with the longitudinal direction of the tape, for the erasing ink on the tape to be transferred over the character etc. to be erased effectively. In that case, the erasing ink transfer tape unwound from the first reel, i.e. the used portion of the tape, is wound up by the second reel not to slack unnecessarily.

The present invention relates to a setup to realize the above effect and enables erasing by the use of an erasing ink transfer tape with full reservation of the general-purpose feature of the conventional erasing ink.

What is claimed is:

1. An eraser for erasing characters, symbols or the like comprising a magazine having set therein a carriage means for mounting thereon to turn freely a first reel loaded with an erasing ink transfer tape, a second reel for winding up erasing ink transfer tape unwound from said first loaded reel and a head, said head including a body portion and a tip portion formed separately from said body portion swinging means mounting said tip portion to said body portion, said swinging means including a shaft portion means formed on a base side of said tip portion and a mating shaft groove means formed in a front end face of said body portion, said tip portion being fitted in said body portion in a freely turning manner, wherein said head causes said unwound tape to be bent or curved before it is wound up by said second reel, and wherein at least said bent or curved portion projects out from said magazine.

2. An eraser as recited in claim 1, wherein said tip portion of said head is swingable up to approximately 15° with respect to said body portion of said head.

3. An eraser as recited in claim 1 or 2, wherein said second reel is driven automatically by a spring-loaded mechanism in response to slackness in said tape on the side of said head where said second reel winds up said tape and said mechanism is disabled in the absence of slackness by the unwinding resistance of said tape.

4. An eraser as recited in claim 1 or 2, wherein said head is held retractable by an escape mechanism with respect to said magazine and is urged to an unretractable position by a spring so that when said head is pressed against paper over said tape, the resultant retraction of said head with respect to said magazine automatically disables said escape mechanism, and when said head departs from paper said escape mechanism becomes effective again.

* * * * *